United States Patent [19]

Formanek et al.

[11] 4,452,078

[45] Jun. 5, 1984

[54] DEVICE FOR CHECKING THE DEPTH REACHED BY A DIGGING OPERATION

[75] Inventors: Jiri Formanek; Rune Nilsson, both of Hofors, Sweden

[73] Assignee: Eurotrade Machine Pool Aktiebolag, Stockholm, Sweden

[21] Appl. No.: 380,064

[22] Filed: May 20, 1982

[30] Foreign Application Priority Data

Jun. 18, 1981 [SE] Sweden ..... 8103846-5

[51] Int. Cl.[3] ..... G01C 5/00

[52] U.S. Cl. ..... 73/432 HA; 33/366

[58] Field of Search ..... 73/432 HA, 301; 33/365, 33/366, 367

[56] References Cited

U.S. PATENT DOCUMENTS

| | | | |
|---|---|---|---|
| 2,272,411 | 11/1956 | Cooper | 33/366 |
| 2,851,799 | 9/1958 | Meents et al. | 73/432 HA X |
| 3,223,249 | 12/1965 | Cady | 33/366 X |
| 3,494,202 | 2/1970 | Comey | 73/432 HA |
| 3,566,386 | 2/1971 | Hamilton | 33/366 X |
| 3,724,278 | 4/1973 | Harland | 73/432 HA |
| 3,779,084 | 12/1973 | Nilsson | 73/432 HA |
| 3,872,725 | 3/1975 | Wojewski | 73/301 X |

*Primary Examiner*—Gerald Goldberg
*Assistant Examiner*—Joseph W. Roskos
*Attorney, Agent, or Firm*—Gifford, Van Ophem, Sheridan, Sprinkle & Nabozny

[57] ABSTRACT

This invention concerns a device for checking the depth reached by operation of a digging machine including a digging implement (11) arranged on an arm (8) pivotably supported relative to the machine. The device comprises a fluid-filled conduit (13) associated with the arm (8) and extending between a location (14) thereon and a location (15) on the machine separated from the arm. The conduit is associated with a pressure sensor (17) for delivering information corresponding to the height of the fluid column between the locations. On the arm (8), there is provided, in addition to the first mentioned sensor (17), a second sensor (18) adapted to deliver information as to the inclination of the arm. In this way, the pressure sensor (17) may be provided at an arbitrary location on the arm 8.

5 Claims, 2 Drawing Figures

DEVICE FOR CHECKING THE DEPTH REACHED BY A DIGGING OPERATION

PRIOR ART

Figure 1:
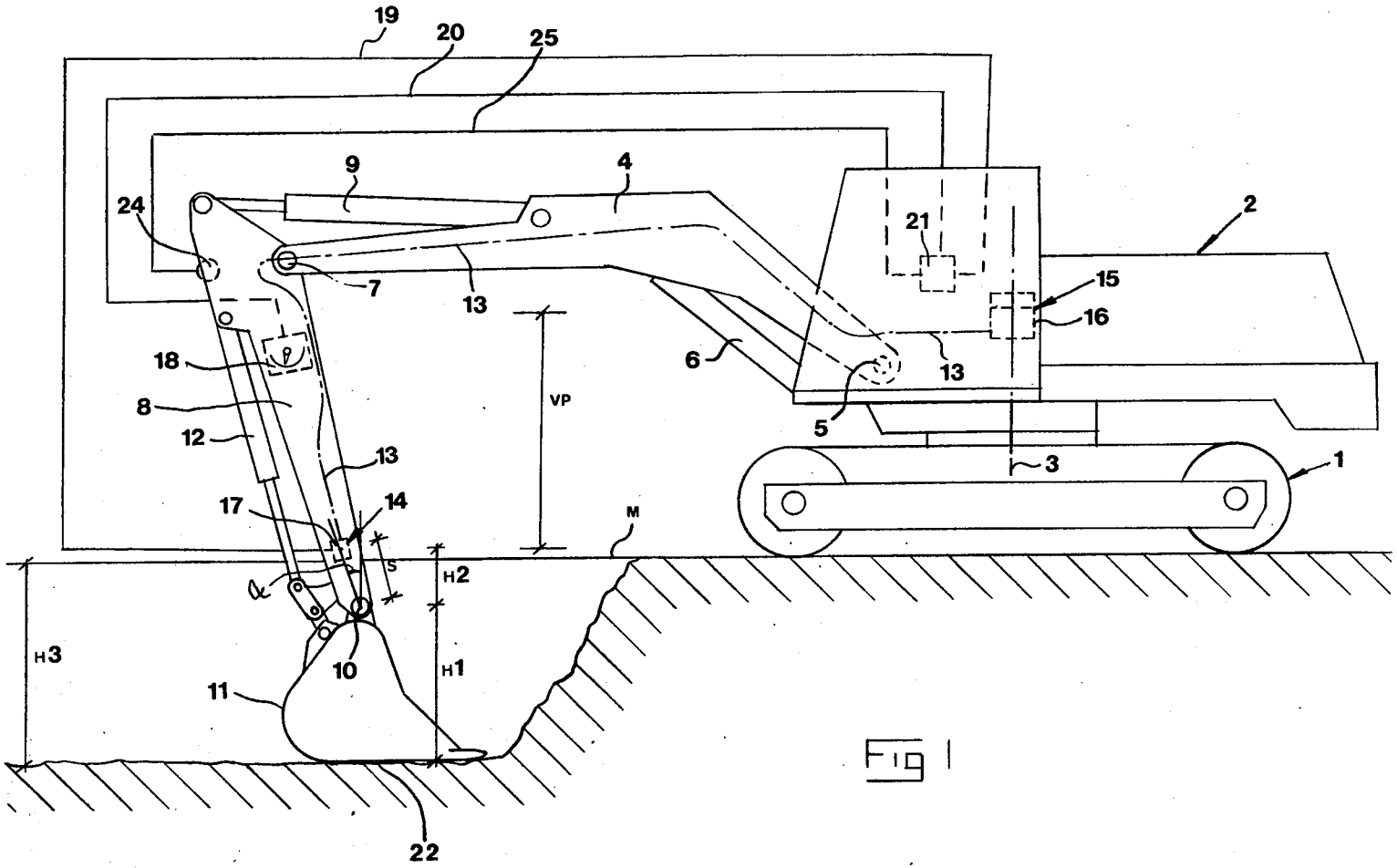

A device for checking the depth reached by operation of a digging machine including a digging implement arranged on an arm pivotably supported relative to the machine is previously known by the Swedish Pat. No. 339 443. A fluid-filled conduit extends along the arm and is at the digging bucket connected to a body having a volume varying under the influence of the pressure of the fluid. The other end of the conduit is located at a location on the machine spaced from the arm and connected to a level meter. At least some sections of the conduit must be flexible. Upon bending of such flexible conduit sections, the fluid volume in the conduit will change considerably, thereby causing, in connection with such a level measuring contemplated in the patent, an unsatisfactory accuracy as to the measuring result. The fluid volume and hence measuring result varies also with temperature changes. An additional problem with this prior device is that the body is disposed on the digging bucket is very exposed to damages and requires protective measures reducing the capacity of the bucket. In addition, it is desirable to be able to change the bucket easily and rapidly. This makes it unsuitable to provide the body on the bucket.

According to a development of this prior device, it has been suggested to replace said body and level meter by a pressure sensor delivering an output signal representative for the height of the fluid column so that the influence of the measuring errors can be reduced, said sensor being located so that it always remains on the arm, more specifically in the vicinity of a hinge between the arm and bucket, so as to allow easy change of bucket. The development within the digging machine field has lately tended towards use of narrower and narrower buckets. For this purpose, the arm and hinge must have a small lateral extent and it has turned out to be difficult to arrange the pressure sensor in the vicinity of this hinge.

The use of laser light has recently been adopted in an expanding extent on building sites and the like so as to define reference levels. It would be desirable to provide a device, by means of which the operator of the digging machine easily may "read" such reference levels without having to turn to separate indicator pins or other more or less primitive accessories.

BRIEF DISCLOSURE OF THE INVENTION

Starting from a device according to the preamble of claim 1, the object of this invention is accordingly to enable elimination of the above problems and enable simple and convenient reading of reference levels established by laser or other facilities.

In accordance with the present invention, this object is obtained by the characteristic feature of claim 1. Thanks to this inclination sensor, freedom is obtained to locate the sensor sensing the height of the fluid column at an arbitrary location on the arm; the information obtained from the two sensors is sufficient for calculation of, e.g., the level of the back of the digging implement relative to a predetermined reference level. Furthermore, a detector sensitive for laser light or other rays or wave motions defining a reference plane, level or line can be arranged at an arbitrary location on the arm. As soon as the detector has been located in said reference plane etc., the level of e.g., the back of the digging implement can be easily calculated from the output signals from the inclination sensor.

Efforts have been made to enable, at digging machines having two pivoted arms, an outreach boom and a downreach boom, measurement of the digging depths by providing inclination sensors on the outreach boom as well as the downreach boom without using measurements of a fluid column. However, this embodiment based on pure inclination measurement gives an unsatisfactory accuracy since a relatively small measurement error concerning the inclination of the outreach boom involves a great error due to the large length of the outreach boom. Furthermore, a condition in this embodiment is that the pivotal connection of the outreach boom to a machine housing rotatably movable relative to a body coincides with the axis of rotation since rotation of the machine housing otherwise would give a measurement error when the machine is not standing on horizontal ground. Finally, it is not possible in this embodiment to change the downreach boom or use an outreach boom having a variable effective length without having the possibility of extensive modification or correction of the measuring system.

BRIEF DISCLOSURE OF THE DRAWINGS

With reference to the appended drawings, a more specific disclosure of an embodiment according to the invention will follow hereinbelow.

Figure 2:
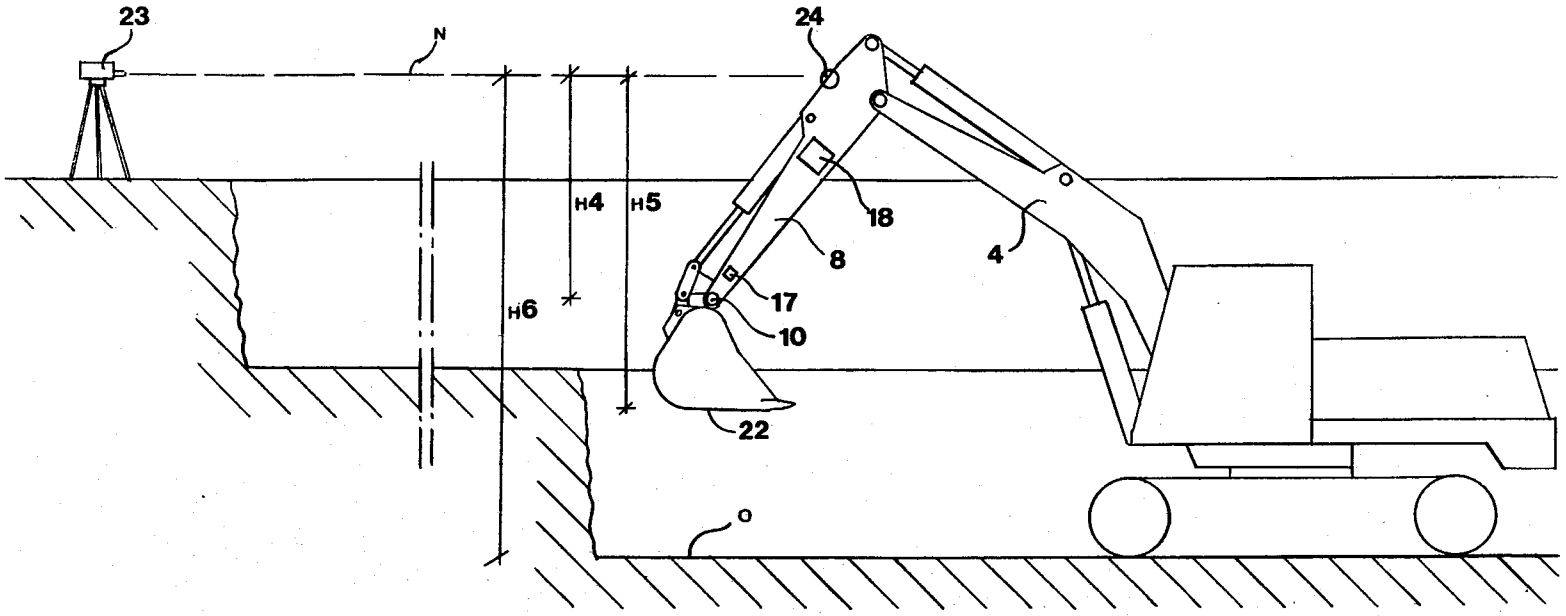

In the drawings:

FIGS. 1 and 2 are diagrammatical views illustrating a digging machine during operation in two different situations.

DETAILED DISCLOSURE OF A PREFERRED EMBODIMENT

The digging machine illustrated in the drawings is of a classic type and has an under body 1 provided with vehicle tracks. On the under body, there is mounted a digging machine housing 2 rotatable relative to the under body about a generally vertical axis 3. An outreach boom 4 is connected to the machine housing 2 via a hinge 5 and pivotable about said hinge 5 by e.g., a piston cylinder mechanism 6. At its outer end, the outreach boom 4 is connected via a hinge 7 to an arm 8, also called downreach boom. A piston cylinder mechanism 9 pivots the boom 4 and the arm 8 relative to each other. At the outer end of the arm 8, a digging implement 11 in the form of a bucket is connected via a hinge 10. A piston cylinder mechanism 12 serves to rotate the bucket about hinge 10.

To check the depth of the digging operation, there is a device comprising a diagrammatically indicated fluid-filled conduit 13 associated to arm 8 and boom 4, said conduit 13 extending between a location 14 on arm 8 and a location 15 on machine housing 2. Said conduit 13 may in practice include highly flexible sections at the transitions between machine housing 2 and boom 4 and between the boom and arm 8.

The location 15 on machine housing 2 is constituted by a fluid receptacle 16 having a horizontal sectional area considerably exceeding the cross section of conduit 13, whereby it is obtained that the changes of the volume of conduit 13 occurring due to flexing of the flexible conduit sections and temperature variations will have a very small and hence neglectable influence on the fluid column VP constituted by conduit 13 and extending between locations 14 and 15.

A sensor 17 for delivering information corresponding to the height of the fluid column VP is associated to conduit 13. This sensor 17 is in this case a pressure sensor arranged at the location 14 on arm 8 and actuated by the fluid pressure (fluid column) in conduit 13. The pressure sensor 17 is arranged on arm 8 at a distance S from hinge 10. It is, of course, a considerable advantage that the pressure sensor is not arranged on the digging bucket 11 or in the vicinity of hinge 10 where all measures increasing the dimensions should be avoided.

In a digging machine having an under body and a housing rotatable relative to each other, it is advantageous if the fluid receptacle 16, which above the fluid level in the receptacle may communicate with the atmosphere or stand under constant vacuum or over pressure, is located aligned with the axis 3 of rotation or at least fairly close to said axis since the conditions of measurement in this way will be influenced unconsiderably or not at all by rotation of the machine housing about axis 3 in cases wherein under body 1 stands inclined on the ground.

It is now evident that raising and lowering of location 14 on arm 8 relative to location 15 on machine housing 2 will vary the height of fluid column VP and thereby the indication of pressure sensor 17, which suitably is of an electrical type so that its electrical output signal may be used as a variable magnitude for checking the depth of the digging work. However, since the pressure sensor 17 is located on arm 8 at a distance from hinge 10, this magnitude alone is not sufficient for checking. The distance S is known as is the distance H1, but the vertical component of the distance S depends on the inclination of arm 8.

In addition to the pressure sensor 17, a second sensor 18 adapted to deliver information as to the inclination of arm 8 is arranged on said arm. From the sensor 18, which also can be adapted to deliver an electrical output signal, information as to the magnitude of the angle $\alpha$ can be obtained. Knowing this angle and the distance S, it is now possible to calculate the missing vertical interval H2 between hinge 10 and sensor 17 according to ordinary trigonometric functions.

As is diagramatically indicated in FIG. 1, the output signals from sensors 17 and 18 are via conductors 19 and 20 transmitted to a processing unit arranged in the machine housing 2 and adapted to process the output signals obtained from the sensors so as to calculate a value on the difference in altitude between location 15 (fluid level in receptacle 16) and a specific portion of the digging implement 11, in practice the hinge 10 thereof. In other words, unit 21 is capable of calculating, on basis of the information from the inclination sensor 18, the difference in altitude H2, which subsequently is to be added to the height of the fluid column VP determined by pressure sensor 17.

The unit 21 includes an electronic digging depth indicator which in practice may be used as follows: When an excavation is to be made, the bucket 11 is first put with the back 22 thereof level with a known starting or reference level. The depth indicator may be set to zero on this reference level. For the sake of simplicity, it is assumed that this reference level corresponds to the ground level M in FIG. 1. In the process of the digging operation, the operator may now check the digging depth by applying the back 22 of the bucket against the bottom of the excavation in accordance with FIG. 1. On the depth indicator, a value may now be read which corresponds to the depth H3 of the excavation since the indication of the altitude previously had been set to zero on reference level M. When the desired depth has been reached, the operator may again set the indicator to zero, whereafter the bottom portion in question of the excavation will form a reference level.

It is, of course, important to adjust the bucket 11 in the same way on setting of the reference level (setting to zero) and reading of differences relative to said reference level.

In FIG. 2, there is illustrated a working site, where excavations having varying bottom levels are to be made with the digging machine. On working sites of this kind, normally building sites, there is often means for establishing a reference level N. Said means is normally constituted by a laser 23 rotating in a horizontal plane.

As appears from FIG. 2, a detector 24 sensitive for laser light or the like is arranged on arm 8. Detector 24 is in a manner diagramatically indicated in FIG. 1 connected to processing unit 21 via an electrical line 25. After having located boom 4 and arm 8 in such positions that detector 24 is in reference level N, processing unit 21 is capable of calculating the difference in altitude H4 between the reference level and hinge 10 on basis of the inclination information from inclination sensor 18 and on information, which may be programmed into processing unit 21, as to the position of detector 24 on arm 8 and possibly add the height H1 of the bucket (adjustable from the machine cabin) thereto so that H5 can be obtained. If the position of the detector 24 on arm 8 coincides with the position of pressure sensor 17 on said arm (which is the preferred embodiment although it has not been illustrated for the sake of clarity) it is now sufficient to store, in a suitable memory, information as to the output signal of the pressure sensor when the detector 24 is in the level N so as to be able to calculate the level of hinge 10 or the back 22 of the bucket relative to level N after movement of arm 8 and the bucket 11. If the back 22 of the bucket 11 is, e.g., lowered against the bottom level 0, processing unit 21 may calculate the height H6 by initially calculating the lowering of the detector and pressure sensor location by a comparison of the pressure sensor output signal in question with the stored information, whereafter the height H2, which is calculated by means of the output signal of the inclination sensor 18, as well as the height H1 of the bucket are added to the amount of lowering. If H6−H1, i.e. the height between level N and hinge 10, is desired, the addition of H1 is avoided. In the manner described, the position of level O relative to reference level N may be determined in a simple way without need for the operator to call for assisting personell.

The invention may, of course, be modified in several ways within the scope of the appended claims. For example the expression "digging machine ", includes any machine intended for digging or similar work, e.g. back hoe machines, wheel supported digging machines, dredging machinery and other floating or land based digging devices, in addition to the exemplified digging machine carried by bands.

We claim:

1. A device for checking the depth reached by operation of a digging machine including a digging implement arranged on an arm pivotably supported relative to the machine comprising:

a fluid-filled conduit associated with the arm and extending between a first sensor located on the arm and a first location on the machine separated from the arm;

wherein said first sensor delivers information corresponding to the height of the fluid-filled conduit above a predetermined reference level;

a second sensor for delivering information as to the inclination of the arm; and a processing unit for automatically processing information received from said first and second sensors and calculating the difference in altitude between said first location on the machine or a set reference position and a position on the digging implement or arm.

2. A device according to claim 1 wherein said first sensor is a pressure sensor actuated by the fluid pressure in said fluid-filled conduit.

3. A device according to claim 1 further comprising a detector arranged on the arm wherein said detector is sensitive to laser light, or other rays, wave motions or means defining a reference plane, level or line.

4. A device according to claim 3 wherein said processing unit is adapted to automatically calculate the difference in altitude between said detector and said position on the digging implement or arm.

5. A device according to claim 3 wherein said detector and said first and second sensors are disposed at the same location or level on the arm.

* * * * *